US005370278A

United States Patent [19]

Raynie

[11] Patent Number: 5,370,278

[45] Date of Patent: Dec. 6, 1994

[54] PORTABLE LIQUID DISPENSING TOY

[76] Inventor: Art Raynie, 12811 El Sendero, San Antonio, Tex. 78233

[21] Appl. No.: 101,405

[22] Filed: Aug. 3, 1993

[51] Int. Cl.[5] ..... B67D 5/44

[52] U.S. Cl. ..... 222/175; 222/333; 222/144.5; 446/27; 446/475

[58] Field of Search ..... 222/79, 175, 192, 333, 222/144.5; 2/DIG. 11, 209.3, 171; 446/27, 475

[56] References Cited

U.S. PATENT DOCUMENTS

| | | | |
|---|---|---|---|
| 1,410,026 | 3/1922 | Monosmith | 222/79 |
| 2,513,506 | 7/1950 | Mendelson | 272/27 |
| 3,040,932 | 1/1962 | Barricks | 222/79 |
| 3,197,070 | 7/1965 | Pearl et al. | 222/79 |
| 3,309,691 | 5/1967 | Bonanno | 273/DIG. 17 X |
| 3,509,584 | 5/1970 | Sable | 4/172 |
| 3,523,645 | 8/1970 | Beauchamp | 222/175 X |
| 4,179,753 | 12/1979 | Aronberg | 2/DIG. 11 X |
| 4,209,113 | 6/1980 | Kuna | 222/79 |
| 4,750,641 | 6/1988 | Chin-Fu | 222/333 X |
| 4,768,681 | 9/1988 | Dean et al. | 222/79 |
| 4,801,088 | 1/1989 | Baker | 222/333 X |
| 4,807,813 | 2/1989 | Coleman | 222/175 X |
| 4,815,635 | 3/1989 | Porter | 222/192 X |
| 4,890,767 | 2/1990 | Burlison | 222/192 X |
| 4,903,864 | 2/1990 | Sirhan | 222/333 X |
| 4,925,105 | 5/1990 | Lin | 222/333 X |
| 4,988,111 | 1/1991 | Gerlizt et al. | 273/DIG. 17 X |
| 5,158,212 | 10/1992 | Sirhan | 222/175 |
| 5,167,554 | 12/1992 | Tager et al. | 441/131 |

*Primary Examiner*—Andres Kashnikow
*Assistant Examiner*—Kenneth Bomberg
*Attorney, Agent, or Firm*—Gunn, Lee & Miller

[57] ABSTRACT

Applicant's invention is a portable liquid dispensing apparatus used as a toy which sprays liquid from a liquid outlet port mounted to a headband which is worn by the user. The apparatus includes a carrier and at least one liquid storage reservoir. The carrier is secured to the user by a transport belt which passes through the carrier and around the midsection of the user. A reservoir tube connects each liquid storage reservoir to a directional flow valve and relay hose leading to the discharge chamber, providing a link between the liquid storage reservoirs and the liquid outlet port. An activation button engages a pump and a power source, driving liquid through the relay hose from a liquid storage reservoir to the discharge chamber and subsequently to and past the liquid outlet port.

11 Claims, 3 Drawing Sheets

PORTABLE LIQUID DISPENSING TOY

BACKGROUND OF THE INVENTION

1. Field of the Invention

This invention generally relates to liquid dispensing devices, more specifically to a liquid dispensing device used as a toy which sprays liquid from a liquid outlet port mounted to a headband which is worn by the user.

2. Background Information

Since their inception, water toys have consistently been the favorite toys of most children. Some adults even enjoy playing with the various water toys. The water toys, however, with the greatest long standing popularity are those that "fire" or discharge the water or other liquid contained within.

Over the past several years, there has been an even greater rise in popularity among water toys, particularly since new designs to various water guns have been introduced. These new designs include sophisticated water rifles, water machine guns, and various other toy liquid dispensing devices. A child holds and aims these water rifles and water machine guns much like the real firearm. Some of these water guns even require a rifle-like pumping action for firing; an increased air pressure forcing liquid out of the device. Positive responses to the introduction of new designs, however, has put pressure on the water toy market and manufacturers to produce even more sophisticated and modern water toy designs.

Many new designs, several of which incorporate air pressure as a means for dispensing the water or liquid, exhibit an increased firing range over those water toys previously on the market. These water toys are typically the most popular since they allow the user to successfully hit targets at further ranges, broadening the games that may be played with the water toys.

In addition, the standard water pistol has also undergone design changes and improvements. It is not uncommon to find water pistols which are intricately designed to copy or mimic the actual handgun. In general, most new pistol designs are larger allowing greater water or liquid storage and subsequent play time between refills.

Although there are many water designs currently on the market, most require that the child hold, carry and/or fire the toy or device with one or both hands. This inhibits movement of the child since it may be difficult to run or maneuver during play with water toys if one or both hands must be used to hold, carry and/or fire the water toy. In addition, since the child must carry the water toy, the size of the liquid reservoir located on or within the toy is restricted due to weight. A child would be unable to safely run and/or maneuver if the water toy was too heavy.

U.S. Pat. No. 3,197,070 issued to Pearl et al. on Jul. 27, 1965, incorporates liquid tanks worn on the back of the user. A tube or hose connects the liquid reservoirs with the actual liquid dispensing toy. The portion of the toy which dispenses the liquid, however, is still carried by the user requiring use of one or both hands for aim and manipulation during play. Again, this required use of the hands restricts movement of the child as it is more difficult to run, turn, and jump when one or both hands are required for stabilizing, aiming, and firing the toy.

U.S. Pat. No. 4,768,681 issued to Dean et al. on Sep. 6, 1988, discloses a design for a fluid action toy which is worn on a child's hand by means of a glove. Since the toy is worn on the hand, however, the size of the water reservoir which is located within the toy is restricted requiring frequent liquid refills.

Further, the water toys available today require the user, which is normally a young child, to have fairly advanced eye to hand coordination for accurately aiming and firing the toy. None of the current water toy designs allow for accurate use by children with less advanced coordination.

There is a need, particularly with the rising popularity of children's water toys, for a modern design liquid dispensing device or toy which allows for increased mobility and improved balance of the user through liberation of one or both of the user's hands. This water toy should not require advanced eye to hand coordination for accurate use as a child would more likely enjoy the success of hitting his or her target. At the same time, there is a need for an easily handled liquid dispensing device or toy which provides a liquid storage capacity which eliminates frequent refills of the liquid reservoirs. Applicant addresses these needs through the liquid dispensing apparatus more fully described below.

SUMMARY OF THE INVENTION

The present invention is a portable liquid dispensing apparatus which sprays liquid from a liquid outlet port mounted to a headband which is worn by the user. The liquid dispensing apparatus consists of a carrier and at least one liquid storage reservoir which is placed in the carrier for easy transport. The carrier is secured to the user by a transport belt or strap which passes through the carrier and around the midsection of the user. A reservoir tube connects each liquid storage reservoir to a standard flow switch and relay hose leading to the discharge chamber, providing a link between the liquid storage reservoirs and the liquid outlet port. Liquid is pumped through the relay hose from a reservoir to the discharge chamber and subsequently to and past the liquid outlet port by a pumping means which is also worn and transported within the carrier. This pumping means is engaged by depressing an activation button which may be attached to the transport belt. The activation button engages a power source and subsequently the pumping means. A standard flow switch provides fluid communication between one reservoir and the relay hose such that the pump, located between the relay hose and flow switch, drives the liquid to and past the liquid outlet port on the headband.

It is an object of applicant's invention to provide a portable liquid dispensing apparatus which, by incorporating a liquid storage reservoir carrier, permits use of adequately sized liquid storage reservoirs with prolonged use without reservoir refill.

It is also an object of applicant's invention to provide a portable liquid dispensing apparatus which, by incorporating a discharge chamber and liquid outlet port mounted on a headband, liberates use of the hands and arms.

It is another object of applicant's invention to provide a portable liquid dispensing apparatus which permits desired movement and maneuvering by the user.

It is yet another object of applicant's invention to provide a portable liquid dispensing apparatus which dispenses liquid at considerable distances.

It is another object of applicant's invention to provide a liquid dispensing apparatus which is aimed and directed solely through the use of eyesight.

It is another object of applicant's invention to provide a portable liquid dispensing apparatus which requires little eye to hand coordination.

Other purposes and advantages will become apparent from the following description in light of the attached drawings.

DETAILED DESCRIPTION OF THE PREFERRED EMBODIMENT

Figure 1:
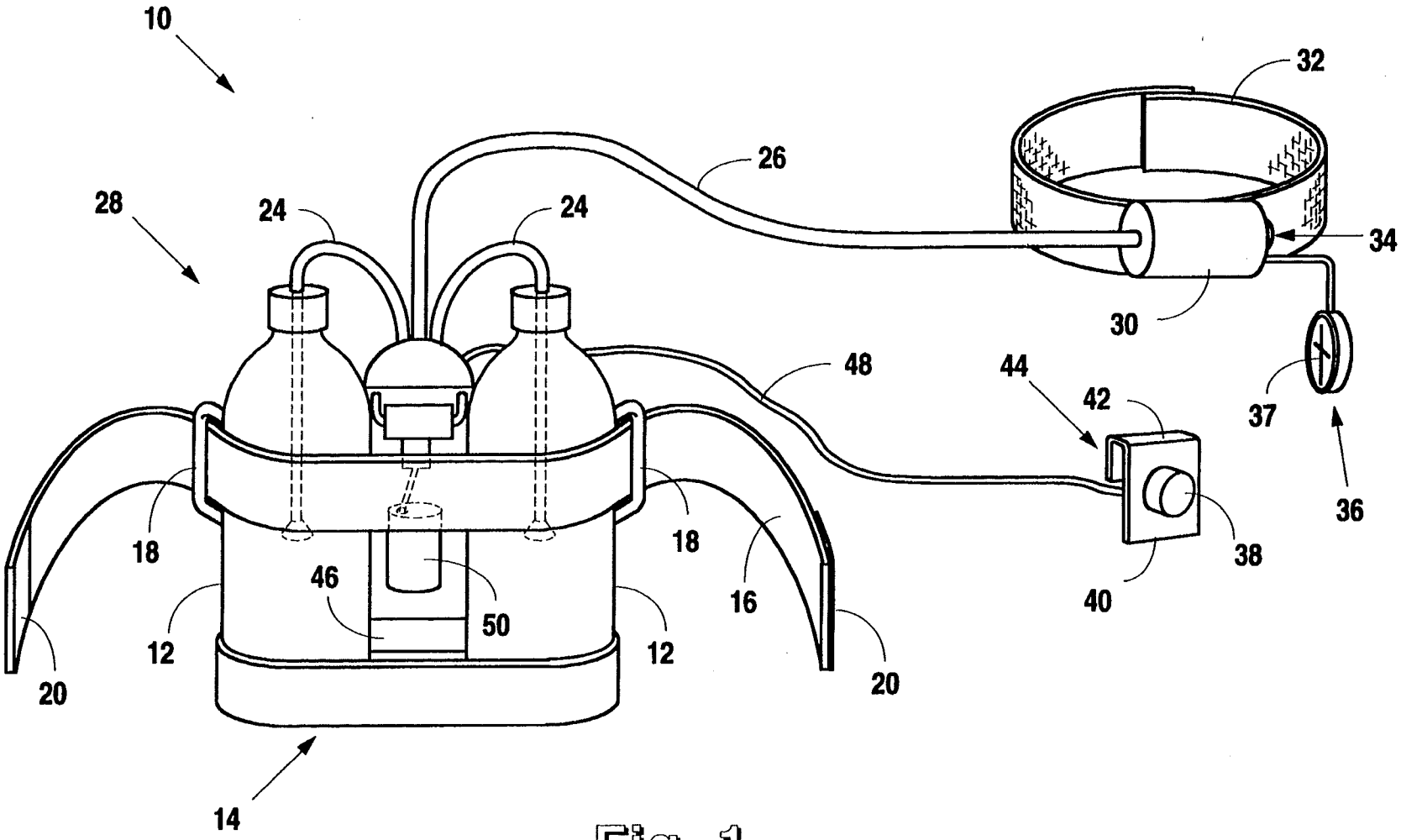
FIG. 1 is a front plan view of the invention as shown with two liquid storage reservoirs.

Referring to FIG. 1, Applicant's preferred embodiment (10) is shown in front plan view. Two large capacity liquid storage reservoirs (12) are positioned securely in the carrier (14). A transport belt (16) or strap passes through an elongated slot (18) at each end of the carrier (14), partially encircling the liquid storage reservoirs (12). The belt (16) is then fastened around the use's midsection by Velcro (TM) (20) or an alternative means such as a buckle, snaps, or hooks.

A substantially vertical straw (22) projects down into each liquid storage reservoir (12) and contained liquid therein for initial transport of the contained liquid into the reservoir tube (24) affixed to the top of the liquid storage reservoir (12). Applicant's preferred embodiment incorporates substantially vertical straws (22) which project down into the liquid storage reservoirs (12) approximately two-thirds the height of the liquid storage reservoir (12) so as to reach minimum liquid levels. Although alternate proportions are acceptable, large liquid storage reservoirs (12) and extended vertical straws (22) eliminate the need for frequent refills of the liquid storage reservoirs (12).

A reservoir tube (24) is affixed to and ascends from each liquid storage reservoir (12). The reservoir tubes (24) then converge at the standard flow switch which allows fluid communication between the selected reservoir (12) and the relay hose (26). This relay hose (26) links the body of the liquid dispensing apparatus (28) to the discharge chamber (30) mounted along an exterior side of the headband (32). Liquid is driven along the relay hose (26) to the discharge chamber (30) and past the liquid outlet port (34). An eye site (36) having cross hairs (37), also mounted to the headband (32), allows for accurate aim and discharge of this liquid for considerable distances from the discharge chamber (30) and liquid outlet port (34) towards a given target.

Also shown in FIG. 1, Applicant's preferred embodiment (10) includes a direct current (hereinafter "DC") activation button (38) affixed to the substantially flat first planar face of a rigid housing (40). An L-shaped extension (42) having two legs is attached to the upper end of the rigid housing's (40) second planar face such that the first leg is perpendicularly secured to the second planar face and the second leg (44) is parallel to the second planar face. The second leg (44) of the L-shaped extension (42) slips over the transport belt (16) for carrying the rigid housing (40) and activation button (38). Depressing the activation button (38) for engaging the power source (46) is therefore possible while the rigid housing (40) and activation button (38) are either fastened to the transport belt (16) or held in a hand.

A DC wire (48) encased in plastic tubing or other protective covering connects the DC activation button (38) to the pump (50) and power source (46). When the activation button (38) is depressed, the pump (50) engages drawing power from a self-contained battery pack (46). The pump (50) drives liquid from the selected liquid storage reservoir (12) through its' reservoir tube (24) to the directional flow valve and relay hose (26), up to the discharge chamber (30), and past the liquid outlet port (34).

Figure 2:
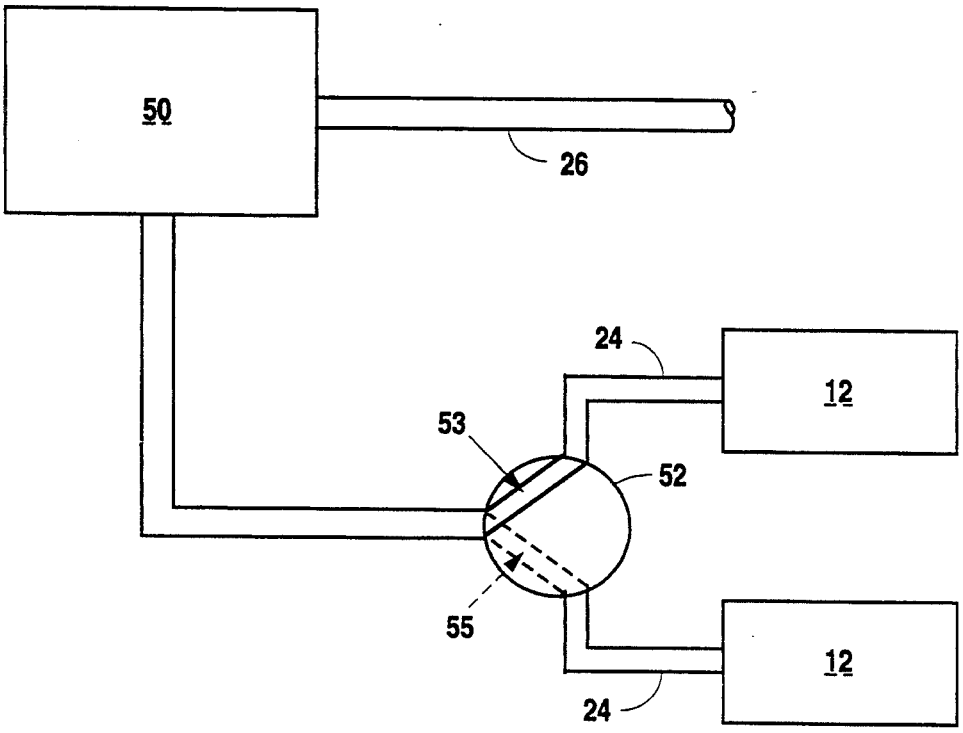
FIG. 2 is a block diagram illustrating the flow of liquid from the liquid storage reservoirs to the relay hose.

Referring to FIG. 2, a block diagram illustrates the flow of liquid from the liquid storage reservoirs (12) to the relay hose (26). A reservoir tube (24) connects each liquid storage reservoir (12) to a directional flow valve (52). This directional valve (52), in its' first position (53),--after (52) permits the flow of liquid from only the selected liquid storage reservoir (12). When liquid in the initial liquid storage reservoir (12) is depleted, the directional flow valve (52) is turned to its second position (55), allowing liquid flow from the alternate liquid storage reservoir (12). The pump (50) drives liquid from the selected liquid storage reservoir (12) through the directional flow valve (52) and into the relay hose (26).

Figure 3:
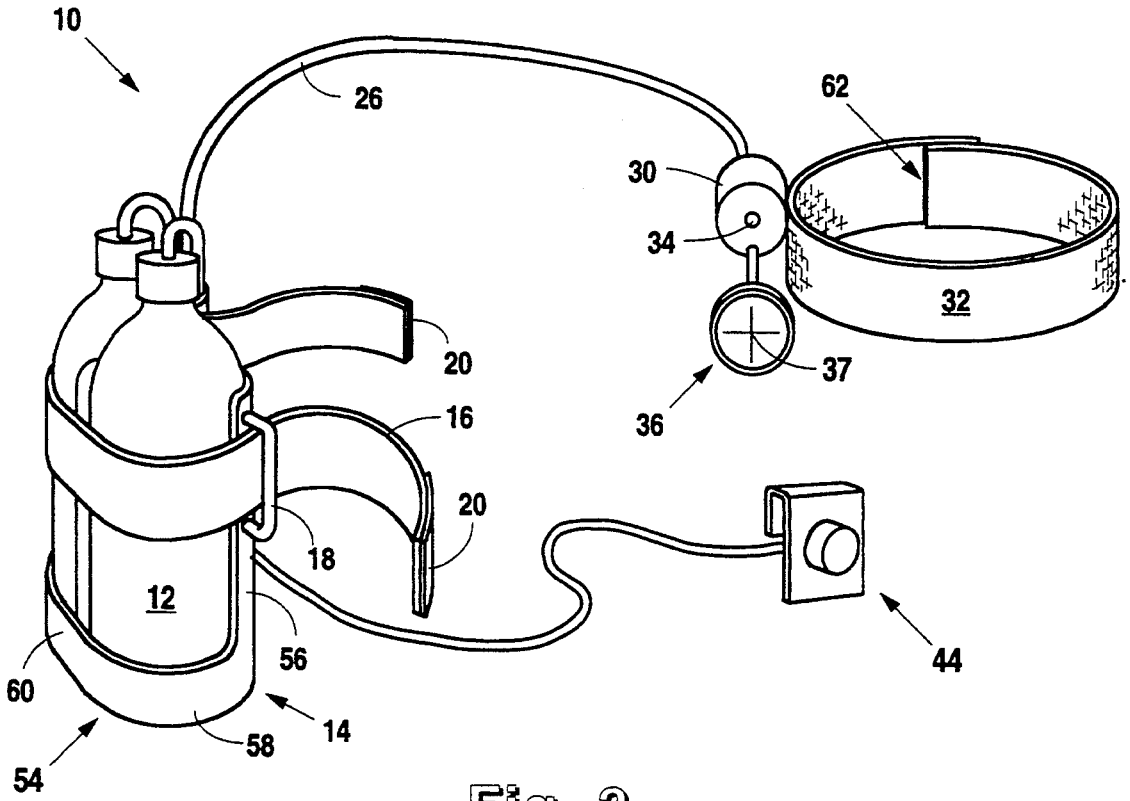
FIG. 3 is a right side view of the invention.

Referring now to FIG. 3, the base unit (54) and vertical supports (56) of the carrier (14) are visible. The base unit (54) consists of an oblong base plate (58) and ridge wall (60) which projects perpendicularly from the base plate (58) along the base plate's perimeter. The oblong base plate (58) provides support for the liquid storage reservoirs (12) while the ridge wall (60) stabilizes the reservoirs (12) so as to prevent toppling or excessive movement of the reservoirs (12) during use. Indentical vertical support members (56) extend from each end of the base unit (54) adjacent the back or rear of the liquid storage reservoirs (12), bracing the liquid storage reservoirs (12) in their upright position.

An elongated slot (18) in each of the outermost vertical support members (56) serve as entry and exit locations for the transport belt (16). The transport belt (16) slides through the first slot (18), partially encircles the liquid storage reservoirs (12), and slides out or exits through the remaining slot (18). Subsequently, when the transport belt (16) is secured around the user's midsection, it concurrently tightens around the liquid storage reservoirs (12), firmly pressing them against the vertical support members (56) for stability.

Referring again to FIG. 3, the discharge chamber (30) and eye site (36) with cross hairs (37) are shown as mounted to the adjustable headband (32). The headband (32) is fastened around the user's head and adjusted accordingly by the adjustment means (62) which in Applicant's preferred embodiment (10) is Velcro (TM). After securely fastening the headband (32) around the user's head and positioning the eye site (36) for use, the device is ready to discharge liquid through the liquid outlet port (34).

Figure 4:
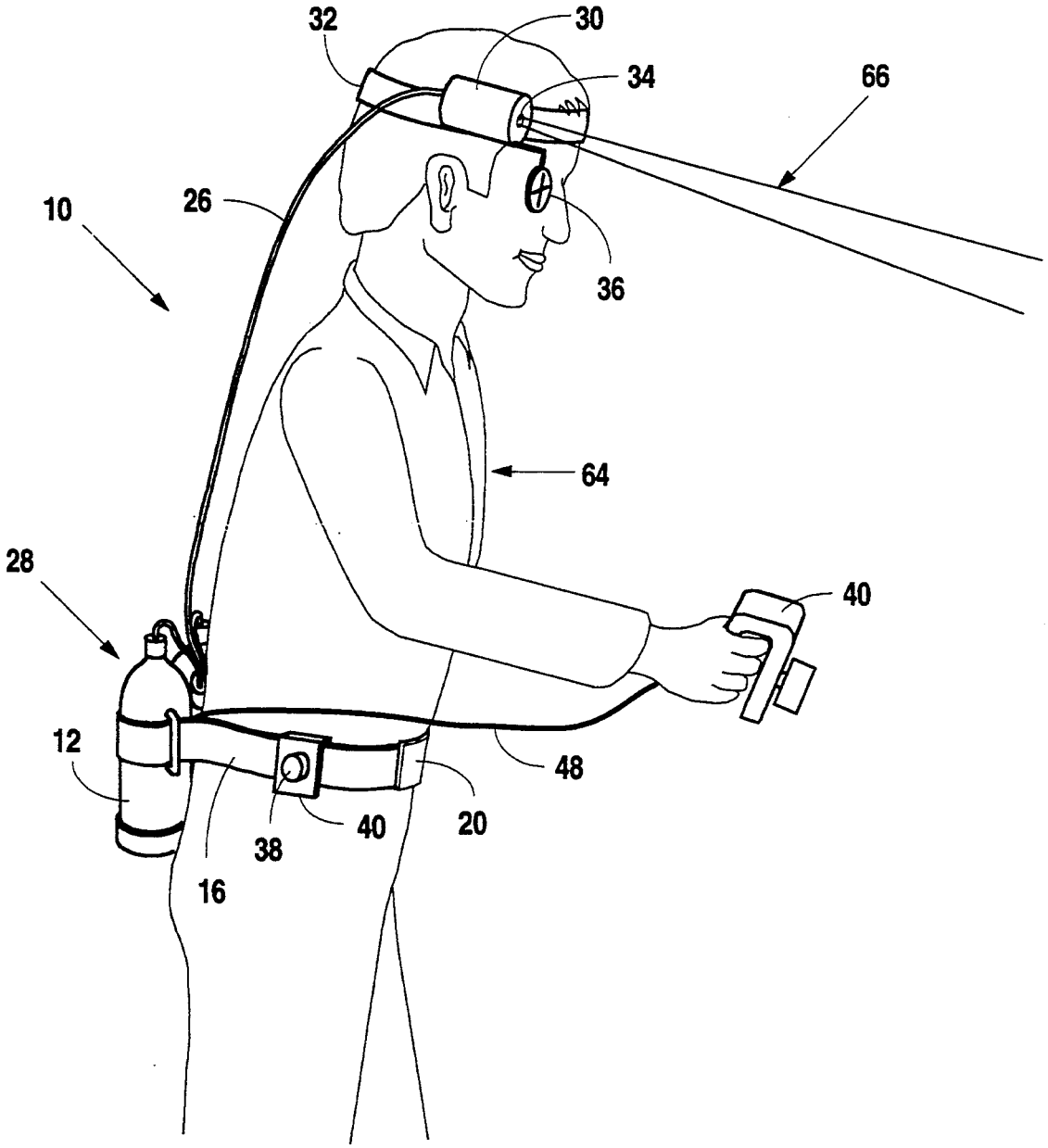
FIG. 4 is the invention during use, wherein the user is holding the activation button.

Referring now to FIG. 4, Applicant's preferred embodiment (10) is shown during use. The transport belt (16) is fastened around the user's midsection and the body of applicant's invention (28) is subsequently secured against the user (64), bracing the liquid storage reservoirs (12) in their upright position. The standard flow switch (52) is set in one of its' two positions, permiting fluid communication between the reservoir tube (24) of the selected reservoir (12) and the relay hose (26).

In FIG. 4, the user (64) is holding the rigid housing (40) and activation button (38) facilitating depression of the activation button (38) and the subsequent discharge of liquid (66). Depression of the activation button (38), however, is also possible while the rigid housing (40) and activation button (38) are alternatively worn on the transport belt (16). (Also shown in FIG. 3).

Referring again to FIG. 4, the user (64) has depressed the DC activation button (38) and engaged the pump (50) (not shown). Liquid is driven or forced up the relay hose (26) to the discharge chamber (30) and eventually past the liquid outlet port (34) as shown. Once the initially selected reservoir (12) is depleted of liquid, the standard flow switch (52) is shifted to its' alternate position such that the remaining reservoir (12) may be utilized without interrupting play for liquid refills.

The eye site (36), also mounted to the headband (32), is positioned over one eye for increased accuracy in aiming and firing the device. Similarly, a light and/or buzzer (not shown) may be incorporated in the circuit formed between the activation button (38), pump and power source. This light and/or buzzer may then be mounted to the headband (32) and activated upon engagement of the pump (50).

Applicant's preferred embodiment (10), shown in FIG. 3, facilitates extended fun and play as the user (64) can easily run, maneuver, and balance since one or both hands are completely free. Large liquid storage reservoirs (12) need few refills and the positioning of the discharge chamber (30) and liquid outlet port (34) require only that the user (64) look in the direction of the target for general aim. Increased accuracy in aim and firing is then facilitated through use of the eye site (36). Once the device is fastened around the user (64), he only need depress the DC activation button (38) for engaging the pump (50) (see FIG. 1) and discharging the liquid (66) at considerable distances.

What is claimed is:

1. A portable liquid dispensing apparatus, comprising:
a. a carrier, said carrier comprising:
i. a base unit;
ii. two vertical support members perpendicularly affixed to said base unit, a first outermost vertical support member having a first slot and a second outermost vertical support member having a second slot; and
iii. a transport belt for stabilizing said liquid storage reservoir within said carrier, said transport belt passing through said first slot of said first outermost vertical support member, around said liquid storage reservoir, and through said second slot of said second outermost vertical support member;
b. at least one liquid storage reservoir, said liquid storage reservoir removably positioned in said carrier;
c. a reservoir tube connected to said liquid storage reservoir for egress of liquid from said liquid storage reservoir;
d. a discharge chamber, said discharge chamber having a liquid outlet port;
e. a relay hose having a first end and a second end, said first end in fluid communication with said reservoir tube and said second end coupled to said discharge chamber;
f. pump means, connected to said liquid storage reservoir, for pumping said liquid from said reservoir tube to said discharge chamber and through said liquid outlet port;
g. power source for providing power necessary for operation of said pump means; and
h. pump activation means, connected to said pump means and said power source, for activating said pump means.

2. The portable liquid dispensing apparatus as recited in claim 1 wherein said base unit comprises a substantially planar base plate and a ridge wall, said ridge wall perpendicularly affixed along the perimeter of said base plate.

3. The portable liquid dispensing apparatus as recited in claim 1 wherein said pump means is electrically powered and said pump activation means comprises a direct current activation button, said direct current activation button affixed to a rigid housing, said activation button serving to electrically connect said pump means to said power source.

4. The portable liquid dispensing apparatus as recited in claim 3 wherein said rigid housing comprises a substantially flat first planar face and a substantially flat second planar face, said activation button affixed to said first planar face of said rigid housing, and an L-shaped extension having a first leg and a second leg affixed to said second planar face of said rigid housing wherein said first leg of said L-shaped extension is perpendicularly secured to said second planar face of said rigid housing and said second leg of said L-shaped extension is parallel to said second planar face of said rigid housing for attaching said rigid housing to said transport belt.

5. The portable liquid dispensing apparatus as recited in claim 3 wherein said power source is a self-contained battery pack, said self-contained battery pack having at least one battery.

6. A portable liquid dispensing apparatus, comprising:
a. a carrier;
b. at least one liquid storage reservoir, said liquid storage reservoir removably positioned in said carrier;
c. a reservoir tube connected to said liquid storage reservoir for egress of liquid from said liquid storage reservoir;
d. a discharge chamber, said discharge chamber having a liquid outlet port;
e. a relay hose having a first end and a second end, said first end in fluid communication with said reservoir tube and said second end coupled to said discharge chamber;
f. pump means, connected to said liquid storage reservoir, for pumping said liquid from said reservoir tube to said discharge chamber and through said liquid outlet port;
g. power source for providing power necessary for operation of said pump means,
h. pump activation means, connected to said pump means and said power source, for activating said pump means;
i. a headband, said headband having said discharge chamber mounted thereto; and
j. a circular eye site adjustably fastened to said headband, said eye site having cross hairs for facilitating the projection of said liquid at a target.

7. A portable liquid dispensing apparatus, comprising:
a. a carrier, said carrier comprising:
i. a base unit;

ii. two vertical support members perpendicularly affixed to said base unit, a first outermost vertical support member having a first slot and a second outermost vertical support member having a second slot; and iii. a transport belt for stabilizing said first and said second liquid storage reservoirs within said carrier, said transport belt passing through said first slot of said first outermost vertical support member, around said first and said second liquid storage reservoirs, and through said second slot of said second outermost vertical support member;

b. a first and a second liquid storage reservoir, said first and said second liquid storage reservoirs removably positioned in said carrier;

c. a first and a second reservoir tube connected to said first and said second liquid storage reservoirs respectively for egress of liquid alternately from either of said first or said second liquid storage reservoirs;

d. a directional flow valve attached to said first and said second reservoir tube, said directional flow valve having a first and a second position, said first position of said directional flow valve allowing fluid communication with said first liquid storage reservoir and said second position of said directional flow valve allowing fluid communication with said second liquid storage reservoir;

e. a discharge chamber, said discharge chamber having a liquid outlet port;

f. a relay hose having a first end and a second end, said first end in fluid communication with either of said first or said second reservoir tubes and said second end coupled to said discharge chamber;

g. pump means, connected to said liquid storage reservoirs, for pumping said liquid from either said first or said second reservoir tube to said discharge chamber and through said liquid outlet port;

h. power source for providing power necessary for operation of said pump means; and i. pump activation means, connected to said pump means and said power source, for activating said pump means.

8. The portable liquid dispensing apparatus as recited in claim 7 wherein said base unit comprises a substantially planar base plate and a ridge wall, said ridge wall perpendicularly affixed along the perimeter of said base plate.

9. The portable liquid dispensing apparatus as recited in claim 7 wherein said pump means is electrically powered and said pump activation means comprises a direct current activation button, said direct current activation button affixed to a rigid housing, said activation button serving to electrically connect said pump means to said power source.

10. The portable liquid dispensing apparatus as recited in claim 9 wherein said rigid housing comprises a substantially flat first planar face and a substantially flat second planar face, said activation button affixed to said first planar face of said rigid housing, and an L-shaped extension having a first leg and a second leg affixed to said second planar face of said rigid housing wherein said first leg of said L-shaped extension is perpendicularly secured to said second planar face of said rigid housing and said second leg of said L-shaped extension is parallel to said second planar face of said rigid housing for attaching said rigid housing to said transport belt.

11. The portable liquid dispensing apparatus as recited in claim 9 wherein said power source is a self-contained battery pack, said self-contained battery pack having at least one battery.

* * * * *